United States Patent [19]

Swapceinski

[11] 4,279,942

[45] Jul. 21, 1981

[54] MAGNETIC FIELD ADJUSTMENT FOR MAGNETIC BRUSHES

[75] Inventor: John P. Swapceinski, Bergen, N.Y.

[73] Assignee: Eastman Kodak Company, Rochester, N.Y.

[21] Appl. No.: 126,798

[22] Filed: Mar. 3, 1980

[51] Int. Cl.[3] ..... G03G 13/08

[52] U.S. Cl. ..... 427/14.1; 118/651; 118/658; 430/103; 430/122

[58] Field of Search ..... 427/14.1; 118/651, 658; 430/103, 122

[56] References Cited

U.S. PATENT DOCUMENTS

| | | | |
|---|---|---|---|
| 3,640,248 | 2/1972 | Nielander | 118/637 |
| 3,654,893 | 4/1972 | Piper et al. | 118/651 |
| 3,855,969 | 12/1974 | Andrako | 118/658 |
| 3,872,829 | 3/1975 | Rattin | 118/658 |

*Primary Examiner*—John H. Newsome

*Attorney, Agent, or Firm*—Raymond L. Owens

[57] ABSTRACT

Apparatus and method for adjusting in situ the conductivity of the developer bristles of a magnetic brush development station in a copier to optimize toner development of electrostatic images.

8 Claims, 2 Drawing Figures

MAGNETIC FIELD ADJUSTMENT FOR MAGNETIC BRUSHES

FIELD OF THE INVENTION

This invention relates to apparatus and method for developing electrostatic images and more particularly to an apparatus and method in which the magnetic field acting upon developer bristles on a magnetic brush is adjusted to improve electrostatic image development.

DEVELOPMENT OF THE PRIOR ART

In electrophotography, it is common to form an electrostatic image on an insulating surface of a photoconductor and to develop that image by applying toner particles thereto to form a visible toner image. Triboelectric developing apparatus are frequently used in the development of electrostatic images. In many of these apparatus, finely divided toner particles are held to the surface of much larger carrier particles by electrostatic charges created by triboelectrification, forming a mixture, called a developer.

Among triboelectric developing apparatus, the most commonly used are cascade apparatus and magnetic brush apparatus. The present invention is concerned with magnetic brush apparatus. In magnetic brush apparatus, the carrier particles are ferromagnetic in nature. Triboelectric charging of the toner particles is generally accomplished by continuous mixing of developer by augers and/or a paddle wheel. The ferromagnetic carrier particles are held to an applicator surface, for example, a rotating nonmagnetic cylinder, in a bristle formation, by a magnetic field produced by stationary magnets located inside the cylinder. The bristles are brushed across a surface carrying an electrostatic image. The electrostatic attraction between the toner and the image overcomes the triboelectrically created attraction between toner and carrier particles, and toner is transferred onto the image thereby developing it.

To prevent attraction of toner to background portions of the electrostatic image, it is a common practice to electrically bias an electrode in the magnetic brush apparatus at a voltage level and at the same polarity as the voltage of the background portion of the images on the photoconductor. The resultant electric fiel, which effects toning of an image, is related to the difference between the charge or voltage on the photoconductor and the bias voltage placed on the electrode. If the developer has a low conductivity, there will be a relatively weak electric field seen by the photoconductor. On the other hand, with developers of a high conductivity, and give the same bias voltage, the photoconductor will see a stronger electric field. If the strength of the electric field is too weak, the developed image will have low density and may appear washed out. If the electric field strength is too strong, background portions will be developed.

SUMMARY OF THE INVENTION

The present invention makes use of the fact that the electrical resistance of developer is a function of its conductivity. The magnetic field from the magnets causes eveloper to coat the cylinder surface so that the coating appears like a fine-bristled brush. The surface of this coating contacts the photoconductor and supplies toner to the electrostatic image. In accordance with the invention, it has been determined that by varying the magnetic field, the electrical resistance of the developer bristles can be adjusted, thereby changing the bristle conductivity. For example, as the magnetic field strength is increased, the toner and carrier particles in the brush bristles pack more densely together, conductivity increases, and electic resistance decreases thereby causing a stronger electric field, with any given bias level, to be seen by the photoconductor. By using adjustable magnetic field producing means in conjunction with an adjustable bias voltage, image development can be significantly enhanced. Proper adjustment of the strength of the magnetic field results in improved development of both large solid areas and lines.

DESCRIPTION OF THE PREFERRED EMBODIMENT

Figure 1:
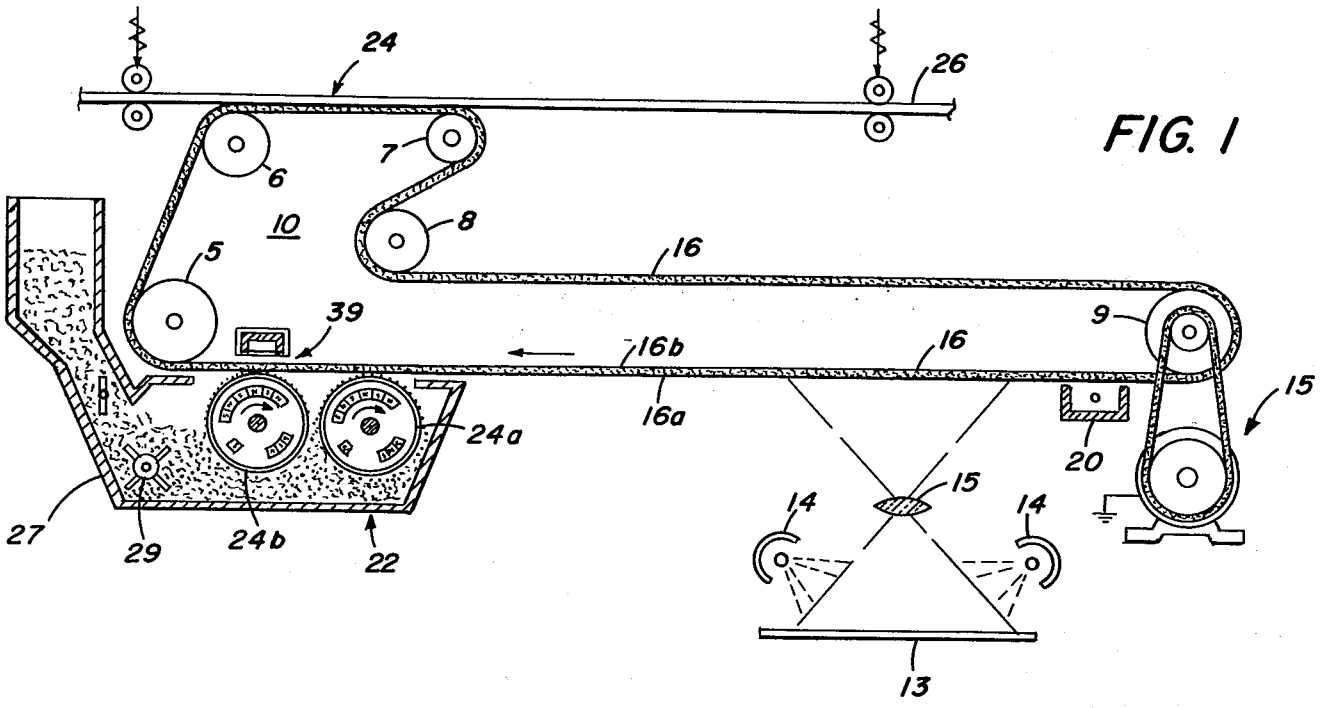
FIG. 1 is a schematic vertical section of a copier apparatus embodying the present invention.

For a general understanding of a web-type electrostatographic reproducing or copier apparatus 10 wherein the invention has utility, reference is made to FIG. 1. As shown, a photoconductor member, in the form of a web 16, is trained about rollers 5 through 9 with the roller 9 being driven by a drive mechanism 15 shown for simplicity to include a motor-pulley arrangement. An insulating surface 16*a* of the web 16 is uniformly charged at a charging station 20. Thereafter, an information medium 13 such as a document is illuminated by radiation from flash lamps 14. Such radiation is reflected from the medium and projected by a lens 15 onto the charged insulating surface 16*a* of the web 16, to selectively dissipate charge and form an electrostatic image of medium 13 on the web. For more specific disclosures of the web construction, see commonly assigned U.S. Pat. Nos. 3,615,406 and 3,615,414, both issued Oct. 31, 1971.

The apparatus 10 further includes a dual magnetic brush apparatus 22 at which the moving electrostatic image is contacted with finely divided charged toner particles that adhere to the charged web surface in a configuration defined by the electrostatic image, to form a visible toner image; a transfer station 24 (not shown) in which the toner image is transferred to a receiving surface of a copy sheet 26 on which it can be subsequently permanently fused; and a cleaning station (not shown) in which residual toner particles are removed from the web 16. For a more complete description of the general organization of a similar copier apparatus, reference may be made to commonly assigned U.S. Pat. No. 4,025,186, issued May 24, 1977 to Hunt et al.

Figure 2:
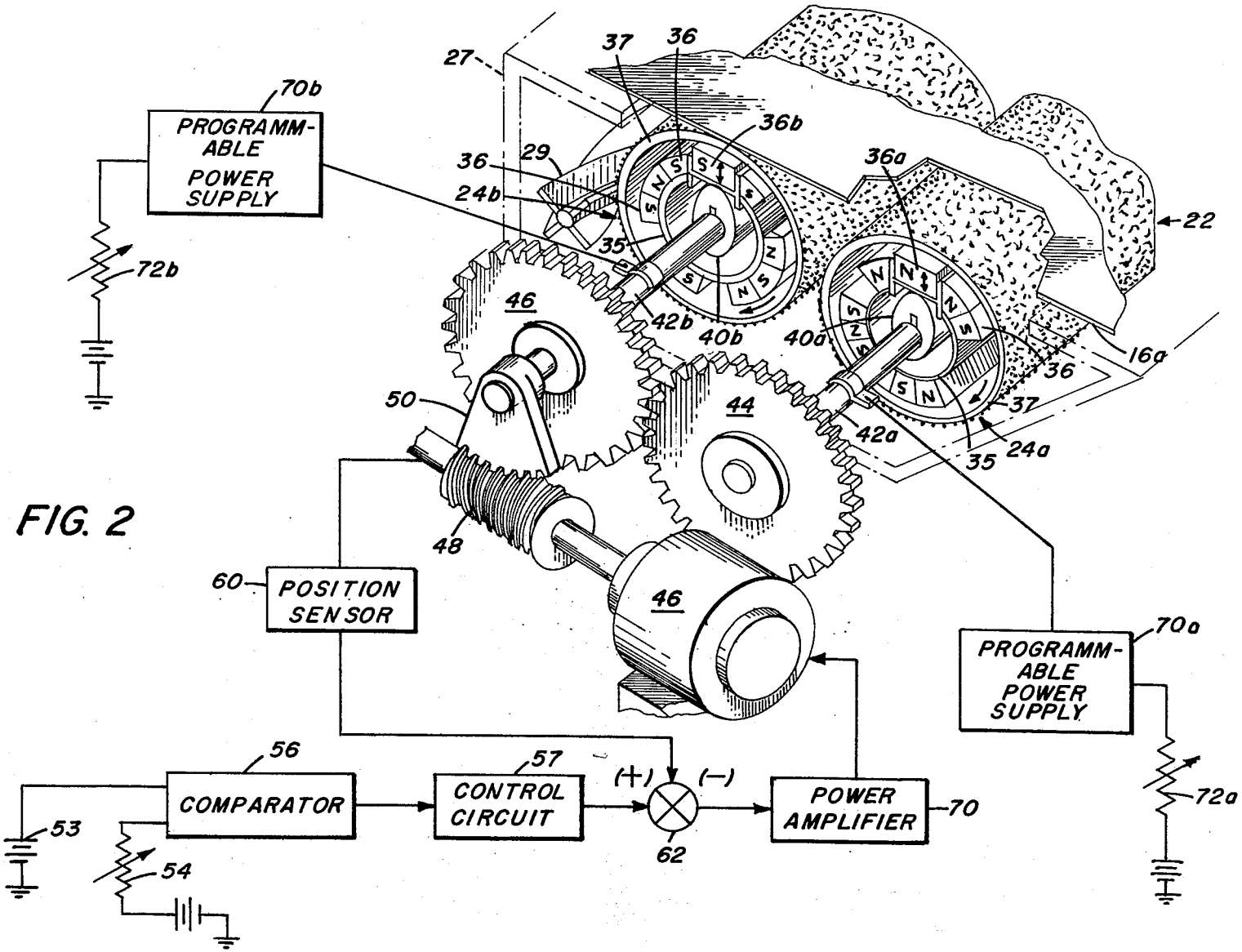
FIG. 2 is a pictorial perspective of the magnetic brush apparatus shown in FIG. 1 and also shows a mechanism for adjusting the strength of the magnetic field which acts at the nip between developer bristles and the photoconductor.

As best shown in FIG. 2, an electrostatic image (not shown) on the insulating surface 16*a* of web 16 is moved past rollers 24*a* and 24*b* mounted in a developer housing 27 which holds a supply of developer consisting of a mixture of toner and carrier particles. The carrier particles are made of a magnetic material such as iron. Simply stated, a magnetic material is one which a magnet attracts. The toner particles are finely divided and are held to the surface of much larger carrier particles by electrostatic charges created by triboelectrification caused by a mixing paddle wheel 29 and augers (not shown). For a specific example of such a developer, see commonly assigned U.S. Pat. No. 3,893,935, issued Jul. 8, 1975 to Jadwin et al. The rollers 24a and 24b can be constructed according to any one of a variety of designs known in the prior art. A preferred configuration shown in FIG. 2 includes a stationary tubular magnetic pole piece 35 formed of soft steel or other magnetic material. Mounted around part of the circumference of the pole piece 35 are permanent magnets 36, formed for example of a rubber bonded barium ferrite strips. Concentric with these magnets 36 and on the outside thereof, is a rotatable, preferably grooved, hollow, nonmagnetic, applicator cylinder 37. The cylinder 37 may be made of aluminum. As the cylinder 37 rotates, by means not shown, developer is held on its surface and moves with the roller while in the field of magnets 36.

The magnetic field from these internal magnets 36 attract the carrier particles and cause the developer to form on the cylinder a nap or coating which appears like a fine-bristled brush. The web is lightly pressed against these bristles, and the bristles supply toner particles to the electrostatic images.

When the developer is brought into contact with an electrostatic image, the charge on the image overcomes the attraction of the carrier for the toner and causes toner to transfer from the bristles to the image. In this process, toner is removed from the developer and carried away on the web 16 for later transfer to copy paper 26. For a more detailed description of a similar dual magnetic brush apparatus, reference may be made to commonly assigned U.S. Pat. No. 3,543,720, issued Dec. 1, 1970 in the names of Drexler et al.

Dual magnetic brushes function very satisfactorily when the applicator cylinders rotate in the same direction. Transfer of toner from bristles on roller 24a has a greater affect on the development of large solid areas then on lines, and transfer of toner from bristles on the roller 24b has a greater affect on the development of lines then on solid areas. For purposes of illustration only, both rollers 24a and 24b are shown similar in construction and include movable magnets 36a and 36b respectively. The magnetic field from these magnets acts upon the bristles which contact the photoconductor. The strength of the magnetic field provided by these magnets 36a and 36b, which acts upon developer, is changed by adjusting the spacing between these magnets and their corresponding cylinders. The magnet 36a is movable by a cam 40a keyed to a rotatable shaft 42a, driven by a gear 44. A gear 46 is keyed to a shaft 42b which rotates a cam 40b that moves the magnet 36b. In order to position the cams 40a and 40b, a motor 46 rotates a worm gear 48. The worm gear 48 is in mesh with a sector member 50 (preferably made of plastic material), which drives shaft 42b. When the shaft 42 rotates, gear 46 rotates the gear 44 which drives the shaft 42a. Rotation of the worm gear 48 by the motor 46 causes the cams 50a and 40 b to adjust the position of the magnets 36a and 36b.

Electrical resistance of developer nap is inversely related to its conductivity. The electrical resistance changes the electric field produced by bias control means now described. Portions of both the rollers 24a and 24b are electrically conductive and act as electrodes for development bias control. The shaft 42b, the cylinder 37 and the cam 40b provide the conductive electrode for the roller 24b. The shaft 42a and cam 40a of the roller 24a also act as a conductive electrode. The shaft 42a is electrically connected to a programmable power supply 70a and a resistor 72a, the resistance of which controls the voltage provided by the supply 70a. Similarly, the shaft 42b is electrically connected to a programmable power supply 70b and a resistor 72b, the resistance of which controls the voltage provided by the supply 70b. For representative disclosures of biasing of magnetic brushes, see commonly assigned U.S. Pat. Nos. 3,575,505; 3,654,893; and 3,674,532. See also Canadian Pat. No. 979,299.

As noted above, the nap on the roller 24a substantially affects the development of solid image areas. The uniformity of solid image area development is dependent on texture of the nap of the developer roller 24a as well as nap conductivity.

Magnetic fibers grow in size and have increased stiffness as the magnetic field is increased. The resistance of the fibers to physical displacement along the surface of the cylinder also increases with magnetic field strength. Nap texture can be described in terms of bristle size and bending bristle resistance to physical displacement. Thus, the position of the magnet 36a changes the magnetic field and controls both nap conductivity and nap texture.

The nap on the roller 24b substantially affects development of line images. With line development, it is desirable to enhance line edges while at the same time keeping background areas clear. For effective line development, it has been determined that the conductivity of the nap on the roller 24b should be relatively low while the applied bias voltage should be relatively high. Thus, in developing images having both solid areas and lines, magnet 36b is generally positioned further from the internal peripheral surface of its cylinder then is magnet 36a, and the bias voltage on roller 24b is higher than the bias voltage for roller 24a. When developing both solid areas and lines there may, with these magnet positions, be a density loss in the leading edges of solid areas. Such density loss can be minimized by reducing the bias voltage on roller 24b or by increasing the conductivity of the nap on roller 24b. The needed adjustment can be determined emperically and is subject to a trade-off between acceptable line and solid area image development.

For illustrative purposes, let us assume background portions of images are being developed. To correct this deficiency, an operator may want to increase the electric field seen by the nap on roller 24a. This can be accomplished by adjusting the resistor 72b which causes the programmable power supply 70b to increase its output voltage. Alternatively, the magnetic field can be increased to change developer bristle conductivity. Towards this end, an operator adjusts a resistor 54 to apply an increased voltage signal to a comparator 56. The comparator 56 also receives a reference voltage from a battery 53. Since there is a difference between these voltages, the comparator 56 applies a signal to a control circuit 57 which produces a positive output which is related to the difference between the two voltage levels which were received by the comparator 56. A position sensor 60 accurately determines the position of the gear 48 and produces an output voltage signal which is a function of such position. A summing node 62, provided, for example, by a summing amplifier, receives the signals from the position sensor 60 and the control circuit 57, and produces an output error signal. A power amplifier 70, in response to the error signal, drives the motor 46 until the error signal is reduced to zero. At such time, the magnets 36a and 36b will have been moved to desired positions. The position of the magnets 36a and 36b adjust the strength of their magnetic field acting on developer nap bristles and thereby changes their conductivity. It will be understood that in accordance with the invention, separated drive mechanisms can be provided for the magnets 36a and 36b to independently adjust their positions.

As developer ages, its resistance usually increases. The applied voltage to the rollers 24a and 24b can be adjusted. Alternatively, the magnetic field acting on the nap can be adjusted to compensate for this aging effect. Thus, for example, the control circuit 57 can be used to cause the power amplifier 70 to move the magnets 36a and 36b closer to their cylinders as a function of developer age.

Assuming the angular velocity of the cylinders 37 is held constant, the rate of flow of developer is a function of the field strength of the magnets 36. In the apparatus shown in FIG. 2, adjustment of the position of the magnets 36a and 36b does not have a significant affect beyond the area where the developer bristles contact the photoconductor. Thus, the field of the magnets 36 remains substantially unchanged, and the flow rate of developer remains relatively constant.

The invention has been described with particular reference to a preferred embodiment thereof, but it will be understood that variations and modifications can be effected within the spirit and scope of the invention. For example, the developer has been described as a two component (toner and carrier) developer, but the invention may be practiced with a single component developer. For a specific example of such a single component developer, see commonly assigned U.S. Pat. No. 3,639,245, issued Feb. 1, 1972 to Nelson.

What is claimed is:

1. In magnetic brush apparatus for developing electrostatic images on an image-bearing member using a developer having a magnetic component, said apparatus including an applicator, magnetic field producing means for forming bristles of such developer on said applicator, means for contacting the bristles and images on the image-bearing member to apply toner particles to the member and bias means for applying an electric field between said applicator and image-bearing member, the improvement comprising:

means for adjusting the strength of the magnetic field forming said bristles to change the conductivity of said bristles and enhance the development of electrostatic images on the image-bearing member.

2. In apparatus for developing an electrostatic image-bearing member and having a magnetic brush which includes an applicator, magnetic field producing means for forming bristles of a developer of toner and magnetic carrier particles on said applicator, means for contacting the developer bristles and the image-bearing member to develop an electrostatic image on the image-bearing member by transfer of toner particles thereto, and bias means for applying an electric field between the bristles and the image-bearing member to reduce the development of background in the image, the improvement comprising:

means for adjusting the strength of the magnetic field provided by said magnetic field producing means to change the electrical conductivity of the developer bristles in contact with said image-bearing member, thereby enhancing the development of the electrostatic image.

3. In magnetic brush apparatus for applying toner to a moving photoconductor carrying an electrostatic image by contacting said photoconductor with a developer having toner and magnetic carrier particles carried on a nonmagnetic, rotating, hollow cylindrical applicator, said apparatus having adjustable bias control means for varying the strength of an electric field between said developer and said photoconductor, the improvement comprising:

(a) adjustable magnetic field producing means within said applicator for producing a magnetic field which acts upon the carrier particles to cause developer to be carried on said applicator; and (b) means for varying the magnetic field of said adjustable magnetic field producing means to adjust the conductivity of developer during contact with said photoconductor to change the strength of the electric field seen by said photoconductor and thereby selectively control the toning of electrostatic images.

4. The invention as set forth in claim 3 wherein said adjustable magnetic field producing means includes a series of permanent magnets located inside said applicator surface with one of said magnets being disposed adjacent to the position where said developer contacts said photoconductor and being movable relative to the applicator to change the strength of the magnetic field which acts upon said carrier particles, and wherein said magnetic field varying means includes means for adjusting the proximity of said movable magnet to the said applicator to effect a change in the developer conductivity.

5. In a dual magnetic brush apparatus for use in applying toner to a photoconductor carrying an electrostatic image by contacting said photoconductor with a developer having a magnetic component, the improvement comprising:

first and second adjacent rollers with each such roller having:

(a) a hollow, non-magnetic, rotatable cylindrical applicator;

(b) adjustable magnetic field producing means located inside said applicator for producing a magnetic field which acts upon said magnetic component and causes said developer to be carried by said applicator;

(c) bias means for applying an electric field between said carried developer and said photoconductor; and (d) means for adjusting the strength of the magnetic field produced by said magnetic field producing means to adjust the conductivity of developer which contacts said photoconductor thereby to change the strength of the electric field seen by said photoconductor and adjust the toning of electrostatic images.

6. The invention as set forth in claim 1 wherein said first and second applicators rotate in the same direction and the electric field of said first roller bias means affects solid area development and the electric field of said second roller bias means affects line development.

7. A method of improving electrostatic image development effected by the contact transfer of toner from magnetic formed bristles of developer to an electrostatic image, comprising the steps of:

(a) producing an electric field which acts upon the bristles during contact with an electrostatic image; and (b) adjusting the strength of the magnetic field in which the bristles are formed to adjust the conductivity of such developer bristles so as to change the electric field seen by said image and thereby adjust the toning of electrostatic images.

8. A method of improving line and solid area electrostatic image development effected by the contact transfer of toner from magnetically formed bristles of developer to an electrostatic image, the bristles being formed on first and second rollers of a dual magnetic brush, comprising the steps of:

(a) producing a first electric field which acts upon the bristles of the said first roller during contact with an electrostatic image and which affects solid area development;

(b) producing a second electric field which acts upon the bristles of said second roller during contact with electrostatic image and which affects line development; and (c) adjusting the magnetic field in which the bristles on said first roller are formed to adjust the conductivity of such developer bristles which changes the electric field seen by said image and thereby adjusts solid area development.

* * * * *